US010604305B2

(12) United States Patent
Lin et al.

(10) Patent No.: US 10,604,305 B2
(45) Date of Patent: Mar. 31, 2020

(54) TAMPER EVIDENT BAG

(71) Applicant: Inteplast Group Corporation, Livingston, NJ (US)

(72) Inventors: Sumei Lin, Morristown, NJ (US); Li-yung Chang, Livingston, NJ (US); Ben Tseng, Somerset, NJ (US)

(73) Assignee: Inteplast Group Corporation, Livingston, NJ (US)

( * ) Notice: Subject to any disclaimer, the term of this patent is extended or adjusted under 35 U.S.C. 154(b) by 0 days.

(21) Appl. No.: 15/941,401

(22) Filed: Mar. 30, 2018

(65) Prior Publication Data

US 2019/0300242 A1 Oct. 3, 2019

(51) Int. Cl.

| | |
|---|---|
| ***B65D 33/34*** | (2006.01) |
| ***B65D 33/20*** | (2006.01) |
| ***B65D 75/58*** | (2006.01) |
| *B65D 33/25* | (2006.01) |

(52) U.S. Cl.

CPC ..... *B65D 33/34* (2013.01); *B65D 33/20* (2013.01); *B65D 75/5833* (2013.01); *B65D 33/2516* (2013.01); *B65D 2101/0023* (2013.01)

(58) Field of Classification Search

CPC ..... B65D 33/34; B65D 33/20; B65D 75/583; B65D 33/2516; B65D 2101/0023; B65D 75/5833; B65D 75/5805; B65D 75/5816; B65D 75/5822; B65D 75/5827; B65D 75/5844

USPC ..... 383/5, 10, 16, 66, 207–209

See application file for complete search history.

(56) References Cited

U.S. PATENT DOCUMENTS

| | | | | |
|---|---|---|---|---|
| 3,090,483 A * | 5/1963 | Altree | B65D 5/5445 206/494 |
| 3,896,966 A * | 7/1975 | Canno | B65D 83/0852 206/494 |
| 4,483,018 A | 11/1984 | Whelan | |
| 4,573,203 A | 2/1986 | Peppiatt | |
| 4,691,368 A | 9/1987 | Roessiger | |
| 4,834,552 A | 5/1989 | Makowka | |

(Continued)

FOREIGN PATENT DOCUMENTS

| | | | |
|---|---|---|---|
| GB | 2035258 A * | 6/1980 | B65D 75/5833 |
| GB | 2339187 | 6/1980 | |

(Continued)

OTHER PUBLICATIONS

Web-page for Seal2Go®—Pan Pacific, http://www.pppmi.com/seal-2-go/, 3 pages.

*Primary Examiner* — Jes F Pascua
(74) *Attorney, Agent, or Firm* — Stinson LLP

(57) ABSTRACT

A tamper evident bag includes a top panel and a bottom panel connected together to define a bag interior between the top and bottom panels. The top panel defines a receiving opening sized and shaped for inserting one or more items into the bag interior. The top and bottom panels each have a tear line with a first end and a second end, the first and second ends being located at the first side edge margin. The first and second ends of each tear line being spaced apart. The tear lines extend over the top and bottom panels and define respective tear out sections of the top and bottom panels. The tear out sections are joined along the first side edge margin and are configured to be removed to create an exit opening.

20 Claims, 5 Drawing Sheets

(56) References Cited

U.S. PATENT DOCUMENTS 4,890,439 A * 1/1990 Smart ..... B65D 81/3461 53/410
4,966,286 A * 10/1990 Muckenfuhs ..... B65D 33/08 206/440
5,048,687 A * 9/1991 Suzuki ..... B65D 71/10 206/494
5,054,619 A 10/1991 Muckenfuhs
D323,797 S 2/1992 Forman et al.
5,163,558 A * 11/1992 Palumbo ..... B65D 75/5833 206/494
5,361,905 A * 11/1994 McQueeny ..... B65D 75/527 206/494
5,372,428 A 12/1994 Bruno et al.
5,482,376 A 1/1996 Moseley et al.
5,593,229 A 7/1997 Warr
5,655,843 A * 8/1997 Conrad ..... B65D 33/10 383/204
5,657,900 A * 8/1997 Scherr ..... B65D 33/14 221/45
5,666,445 A 9/1997 Conrad et al.
5,676,467 A 10/1997 Gebhardt
5,741,077 A 4/1998 Sasaki et al.
5,857,586 A * 1/1999 Scherr ..... B65D 33/14 206/554
5,951,166 A 9/1999 Matsumoto
6,033,392 A 3/2000 Frey et al.
D557,148 S 12/2007 Kapinos, Sr.
7,530,740 B2 5/2009 Geyer
D799,337 S 10/2017 Bhati
2009/0190866 A1* 7/2009 Hughes ..... B65D 75/44 383/207
2010/0166924 A1* 7/2010 Leathersich ..... B65D 75/5805 426/122
2015/0298864 A1* 10/2015 Ausnit ..... B65D 33/007 493/214
2017/0050768 A1 2/2017 Tseng et al.
2018/0162603 A1 6/2018 Tan

FOREIGN PATENT DOCUMENTS

JP H0329754 A 2/1991
JP H08182524 A 7/1996
JP 2009269622 A * 11/2009
JP 2013256306 A * 12/2013 ..... B65D 75/5844
WO 9818678 5/1998

* cited by examiner

TAMPER EVIDENT BAG

FIELD OF THE INVENTION

The present invention generally relates to a bag, and more specifically, to a tamper evident bag used to carry food.

BACKGROUND

Bags are commonly used to hold and enclose food and other products. In one application, bags are used in food delivery applications—to transport prepared meals from a restaurant to a place of delivery, such as a home. When prepared meals are transported in this manner, it is beneficial to provide customers with the confidence that the ordered meals have not been touched or tampered with during delivery, for example, by a delivery driver. To provide such confidence to customers, the customers need to know if the bag is subsequently opened after the food is placed in the bag at the restaurant.

SUMMARY

In one aspect, a tamper evident bag comprises a top panel and a bottom panel having top and bottom surfaces and front, rear, and opposite first and second side edge margins. The top and bottom panels are connected together along the front, rear and first and second side edge margins to define a bag interior between the top surface of the bottom panel and the bottom surface of the top panel. The top panel defines a receiving opening sized and shaped for inserting one or more items into the bag interior. A handle is connected to the top panel. The top and bottom panels each have a tear line with a first end and a second end. The first and second ends are located at the first side edge margin and are spaced from the front and rear edge margins and from each other. Each tear line extends over the top and bottom panels defining a respective tear out section therein. The tear out sections are joined along the first side edge margin and configured to be removed to create an exit opening in the top and bottom panels.

In another aspect, a tamper evident bag comprises a top panel and a bottom panel having top and bottom surfaces and front, rear, and opposite first and second side edge margins. The top and bottom panels are connected together along the front, rear and first and second side edge margins to define a bag interior between the top surface of the bottom panel and the bottom surface of the top panel. The top panel defines a receiving opening sized and shaped for inserting one or more items into the bag interior. A handle is connected to the top panel. The top and bottom panels each have a tear line with a first end and a second end. The first end is located at the first side edge margin and the second end is located at the second side edge margin. Each tear line is adjacent to and generally parallel with the front edge margin. The tear lines extend over the top and bottom panels defining a respective tear out section therein. The tear out sections are joined along the front edge margin and configured to be removed to create a front margin exit opening between the top and bottom panels.

BRIEF DESCRIPTION OF THE DRAWINGS

Corresponding reference characters indicate corresponding parts throughout the drawings.

DETAILED DESCRIPTION

Figure 1:
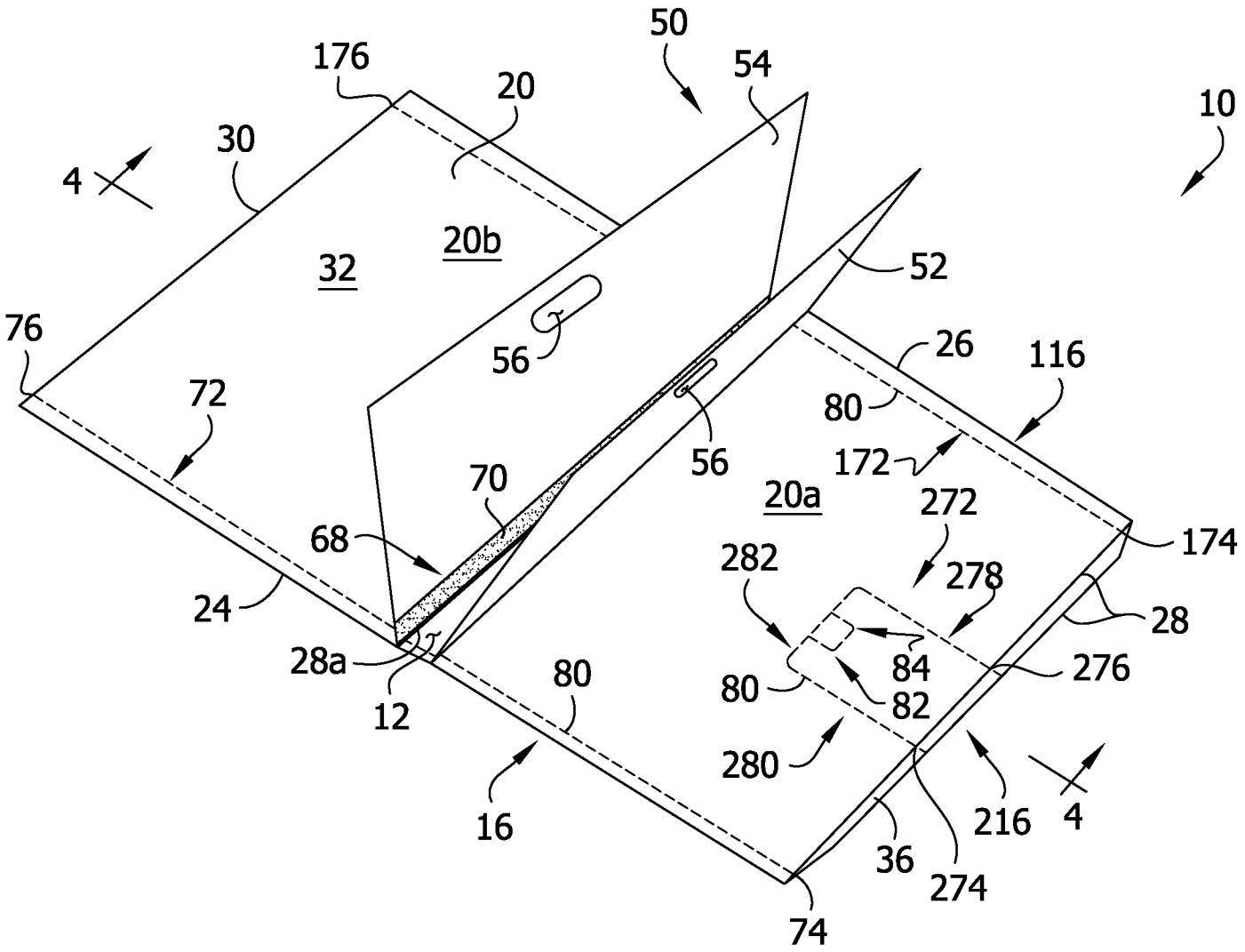
FIG. 1 is a perspective of a tamper evident bag according to one embodiment of the present disclosure with an open receiving opening.
Figure 2:
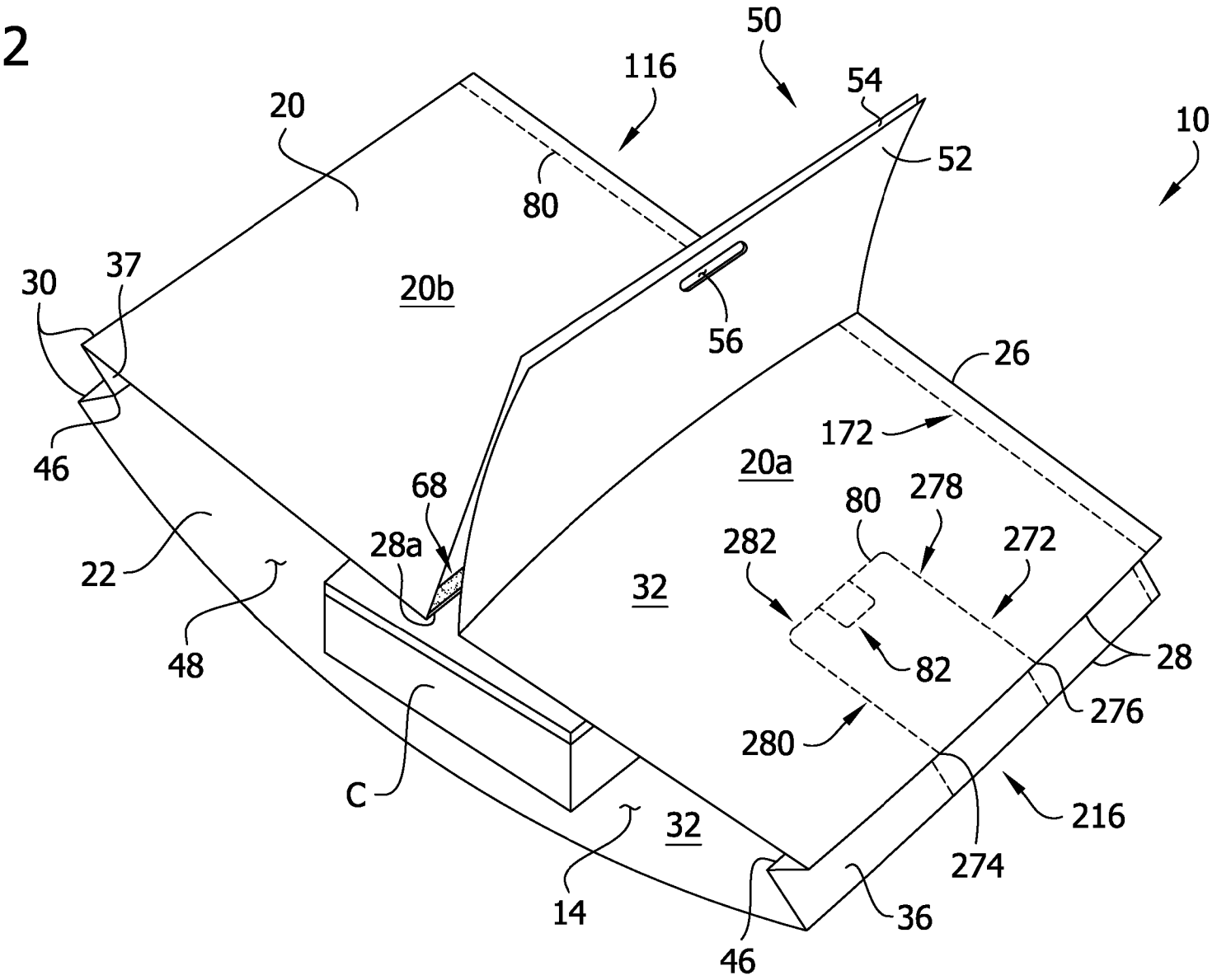
FIG. 2 is a perspective of the tamper evident bag of FIG. 1 with a closed receiving opening and a first tear out section removed.

Referring to FIGS. 1-2, a tamper evident bag of one embodiment of the present disclosure is generally indicated at 10. The bag includes a receiving opening 12 that is configured to be permanently closed. The receiving opening 12 is open when the bag 10 is received at the site where prepared food or another item is inserted into the bag. One or more tear out sections 16, 116, 216 are each configured to be removed from the bag 10 to form an exit opening 14, as will be discussed in more detail below. Once the receiving opening 12 of the bag 10 is closed, the only way to access the contents contained within the bag is to remove one of the tear out sections 16, 116, 216 to create the exit opening 14 (or otherwise tear open the bag). In this manner, by visually inspecting the bag 10 to make sure the receiving opening 12 is sealed, the tear out sections 16, 116, 216 are in place and the bag is not otherwise damaged, the user will know the contents of the bag were not tampered with once the contents were placed in the bag.

Referring to FIGS. 1-4, the bag 10 includes top and bottom panels 20 and 22, respectively. The top and bottom panels 20, 22 are each four-sided with opposite front and rear side edge margins 24 and 26, respectively, and opposite first and second side margins 28 and 30, respectively. The top and bottom panels 20, 22 each have top and bottom surfaces 32 and 34, respectively. The distance between the front and rear side edge margins 24, 26 defines a width W of the bag 10 (FIG. 5). The distance between the first and second side edge margins 28, 30 defines a length L of the bag 10 (FIG. 5). In one embodiment, the bag 10 has a width W of 20 inches (50.8 cm) and a length L of 14 inches (35.5 cm). However, it is understood that other dimensions are within the scope of the present disclosure.

Figure 3:
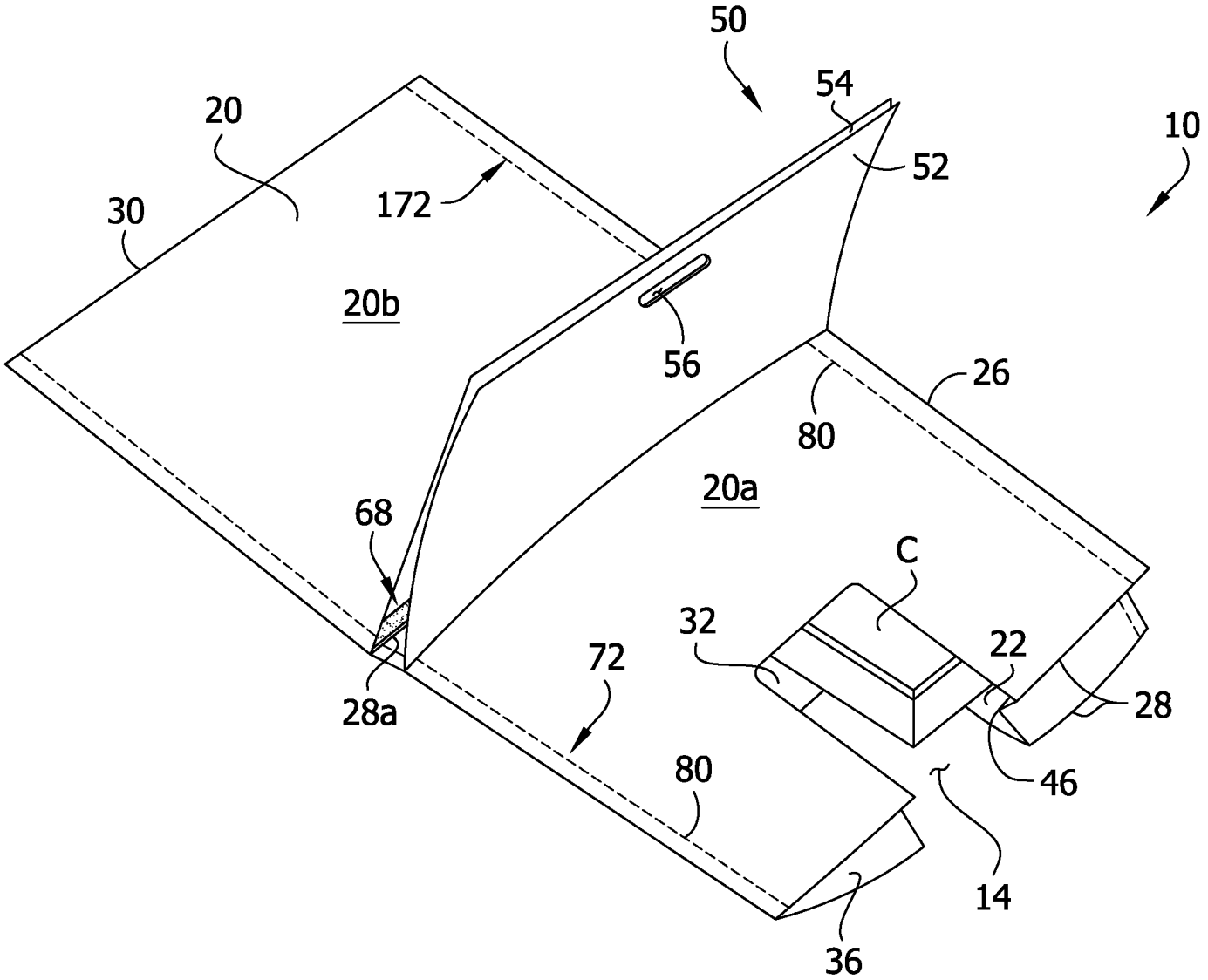
FIG. 3 is a perspective of the tamper evident bag of FIG. 1 with a closed receiving opening and a second tear out section removed.
Figure 4:
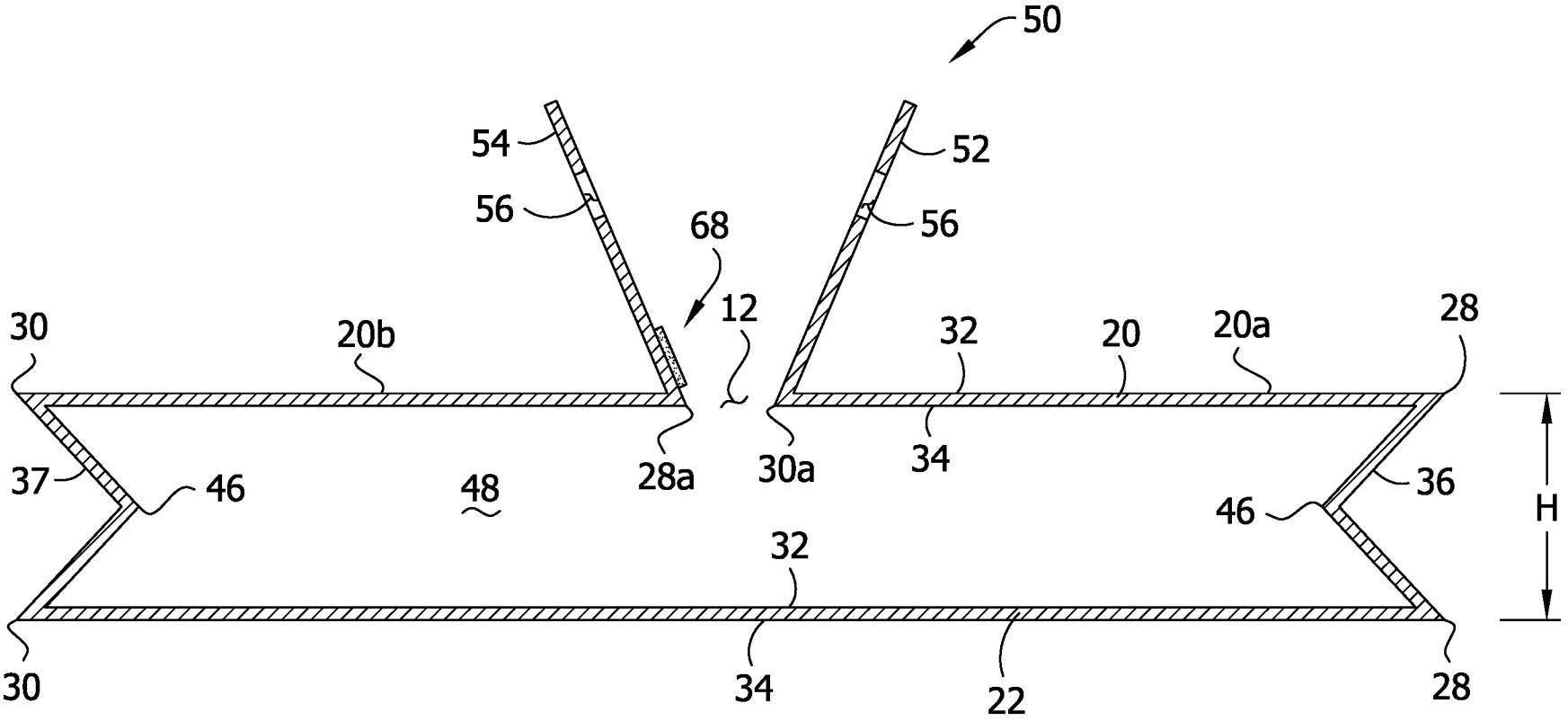
FIG. 4 is a section of the tamper evident bag taken through line 4-4 of FIG. 1.
Figure 5:
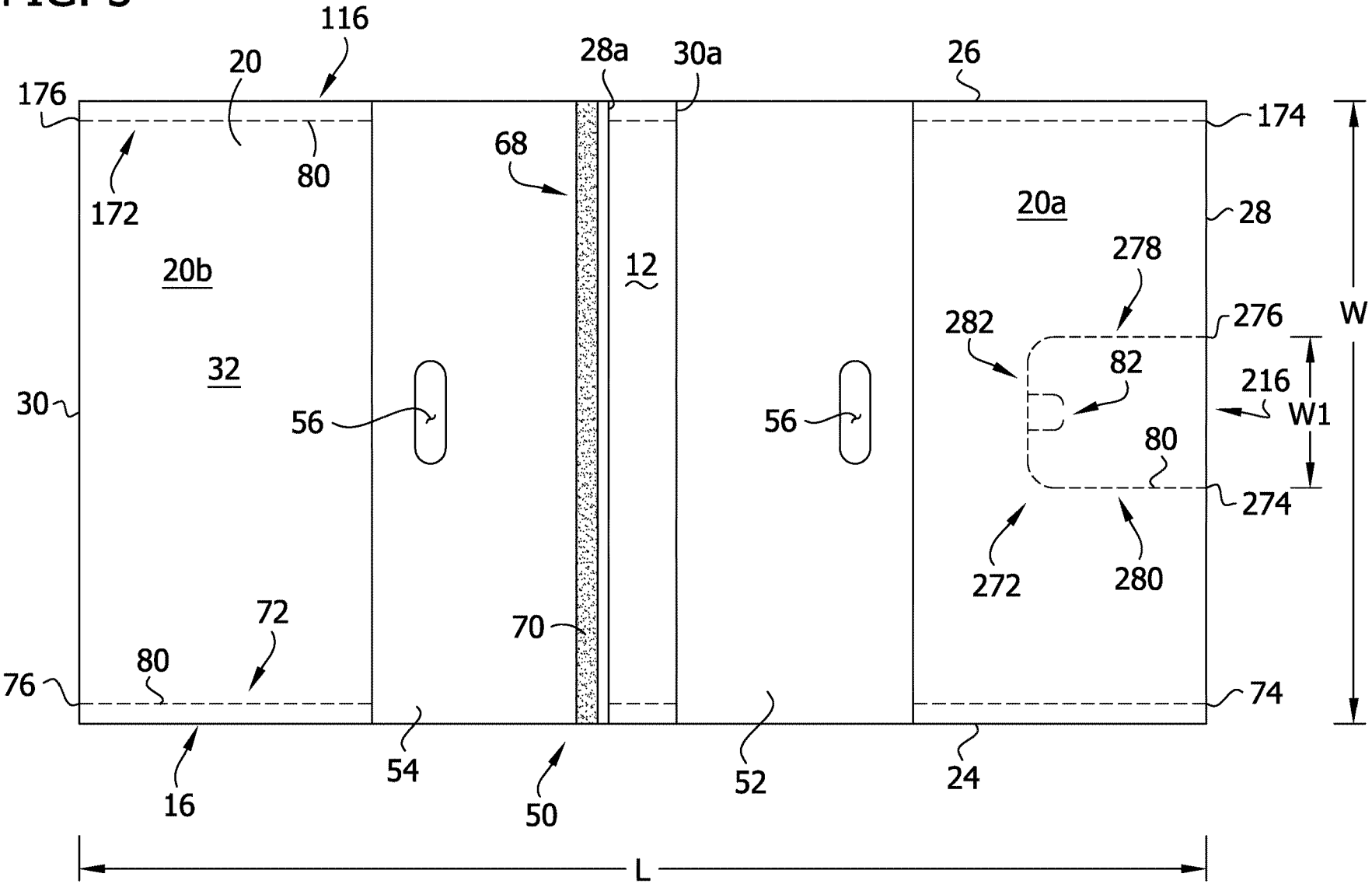
FIG. 5 is a plan view of the tamper evident bag of FIG. 1 in a flat configuration.

Referring to FIGS. 1-4, the top and bottom panels 20, 22 are joined at the front, rear, first and second side edge margins 24, 26, 28, 30. Thus, the top and bottom panels 20, 22 are generally aligned with the top panel overlying the bottom panel. The bottom surface 34 of the top panel 20 and the top surface 32 of the bottom panel 22 define a bag interior 48 therebetween (FIG. 4). The bag interior 48 is sized and shaped to receive one or more items, such as but not limited to one or more containers C, inserted therein. The top panel 20 defines the receiving opening 12 to the bag interior (the receiving opening is, broadly, in communication with the bag interior). The receiving opening 12 is sized and shaped for inserting one or more containers C into the bag interior 48. Preferably, the receiving opening 12 is located near the middle of the length L of the bag 10 such that a midpoint of the length is located in the receiving opening. In the illustrated embodiment, the receiving opening 12 spans between the front and rear side edge margins 24, 26 of the top panel 20. In this manner, the receiving opening 12 divides the top panel 20 into a first top panel member **20*a*** and a second top panel member 20*b*. The first top panel member 20*a* partially defines the front and rear side edge margins 24, 26 of the top panel 20, defines the first side edge margin 28 of the top panel 20 and has a second side edge margin 30*a* opposite the first side edge margin (broadly, the first top panel member has opposite front and rear side edge margins and opposite first and second side edge margins). The second top panel member 20*b* partially defines the front and rear side edge margins 24, 26 of the top panel 20, defines the second side edge margin 30 of the top panel 20 and has a first side edge margin 28*a* opposite the second side edge margin (broadly, the second top panel member has opposite front and rear side edge margins and opposite first and second side edge margins). The second side edge margin 30*a* of the first panel member 20*a* and the first side edge margin 28*a* of the second panel member 20*b* define the receiving opening 12. It is understood that the receiving opening 12 may have other configurations than described herein that are within the scope of the present disclosure. For example, the receiving opening 12 may not span across and divide the top panel 20 into first and second top panel members 20*a*, 20*b*. In this case, a receiving opening (not shown) may be everywhere spaced apart from the front, rear, first and second side edge margins 24, 26, 28, 30 of the top panel 20.

In the illustrated embodiment, the front and rear side edge margins 24, 26 are joined to each other and the first and second side edge margins 28, 30 are joined together with first and second gussets 36 and 37, respectively. First gusset 36 spans between and interconnects the first side edge margins 28 of the top and bottom panels 20, 22 and the second gusset 37 spans between and interconnects the second side edge margins 30 of the top and bottom panels. Each gusset 36, 37 has opposite top and bottom edge margins and opposite front and rear side edge margins. The top edge margin of the first gusset 36 is connected to the first side edge margin 28 of the top panel 20 and the bottom edge margin of the first gusset 36 is connected to the first side edge margin 28 of the bottom panel 22. Likewise, the top edge margin of the second gusset 37 is connected to the second side edge margin 30 of the top panel 20 and the bottom edge margin of the second gusset 37 is connected to the second side edge margin 30 of the bottom panel 22. Each gusset 36, 37 is folded back on itself along a fold line 46. When the bag 10 is in the flat orientation shown in FIG. 5, the fold line 46 is positioned inward of the respective side edge margins 28, 30, between the top and bottom panels 20, 22. For each gusset 36, 37, a segment of the front side edge margin is joined to another segment of the front side edge margin with both segments being joined to the front side edge margins 24 of the top and bottom panels 20, 22. Likewise, a segment of the rear side edge margin of each gusset 36, 37 is joined to another segment of the rear side edge margin with both segments being joined to the rear side edge margins 26 of the top and bottom panels 20, 22. Each gusset 36, 37 can flatten along fold line 46 to increase a height H (FIG. 4) of the bag 10, allowing the bag to better receive and transport taller items or containers C. Alternatively, the bag 10 may include additional gussets (not shown) joining the front side edge margins 24 together and rear side edge margins 26 together. The bag 10 can also be constructed without gussets such that first and second side edge margins 28, 30 are joined to each other.

Referring to FIGS. 1-5, the bag 10 includes a handle 50. The handle 50 is connected to the top panel 20 adjacent the receiving opening 12. In the illustrated embodiment, the handle 50 includes a first handle panel 52 and a second handle panel 54. The first handle panel 52 is connected to the second side edge margin 30*a* of the first top panel member 20*a* and the second handle panel 54 is connected to the first side edge margin 28*a* of the second top panel member 20*b*. The first and second handle panels 52, 54 extend along the receiving opening 12, between the front and rear side edge margins 24, 26 of the top panel 20. The first and second handle panels 52, 54 each define an aperture 56 at the upper end thereof. The apertures 56 are configured to allow a user's hand to be inserted therethrough, permitting the user to grasp and carry the bag 10. The apertures 56 on the first and second handle panels 52, 54 are generally aligned, allowing the user to grasp both handle panels simultaneously. It is understood the handle 50 may have other configurations than described herein that are within the scope of the present disclosure. For example, a handle (not shown) can extend from the front and rear side edge margins 24, 26 along the length L of the bag 10 or can extend from the first and second side edge margins 28, 30 along the width W of the bag.

Referring to FIGS. 1, 4 and 5, the handle 50 is configured to close the receiving opening 12. The second handle panel 54 of the bag 10 includes an adhesive member 68 fixed to the second handle panel. The adhesive member 68 faces the first handle panel 52 and is configured to secure to the first handle panel to close the receiving opening 12. The adhesive member 68 is located proximate the receiving opening 12 and extends between opposite side edge margins of the second handle panel 54. As described in more detail below, the adhesive member 68 is used to permanently close the receiving opening 12. The adhesive member 68 includes a protective release strip (not shown), such as a length of plastic film. The release strip protects the adhesive member 68 from bonding to another surface prematurely and is configured to be peeled away to expose an adhesive 70 of the adhesive member when the receiving opening 12 is ready to be closed, such as after the container C of food has been placed in the bag 10 through the receiving opening 12. Preferably, the release strip does not permanently bond with the adhesive 70 and the adhesive is of a type that adheres strongly on contact with the material of the first handle panel 52. The adhesive member 68 can be fixed to the second handle panel 54 using adhesive, which can be the same as adhesive 70, or any other suitable means for attachment. Alternatively, the bag 10 can include other ways of closing the receiving opening 12 without using the handle 50. For example, the bag 10 may include a closure panel (not shown) configured to extend over and cover (e.g. close) the receiving opening 12. In this case, the closure panel would include the adhesive member that would be secured to a portion of the bag 10 to close the receiving opening 12. Other ways of closing the receiving opening are within the scope of the present disclosure.

In the preferred embodiment, the top and bottom panels 20, 22, the first and second handle panels 52, 54 and the first and second gussets 36, 37 are formed from a single sheet of material that is folded along the first and second side edge margins 28, 30 of the top and bottom panels, the fold lines 46 of the gussets and the first and second side edge margins 28*a*, 30*a* of the first and second top panel members 20*a*, 20*b* (FIG. 4). In this case, the handle 50, top and bottom panels 20, 22, and gussets 36, 37 are continuous with one another. Heat formed fusion lines join the front and rear side edge margins 24, 26, 42, 44. As formed in the illustrated embodiment, the material of the bag 10 extends continuously from the first handle panel 52 lengthwise across the first top panel member 20*a*, the gusset 36, the bottom panel 22, the gusset 37, and the second top panel member 20*b* to the second handle panel 54. This continuity provides for strength when carrying the bag 10 by the handle 50 and avoids premature tearing of the tear out sections 16, 116, 216. Other ways of connecting the top and bottom panels 20, 22, the handle 50, first and second gussets 36, 37 and the front and rear side edge margins 24, 26, 42, 44 are within the scope of the present disclosure. For example, in some embodiments (not shown), fusion lines join adjacent components along a shared edge margin, such as but not limited a fusion line connecting the first side edge margin 28 of the top panel 20 to the top edge margin 38 of the first gusset 36. In some embodiments, the edge margins are joined to form a fluid tight, liquid tight, and/or gas tight seal. In other embodiments, the edge margins can be joined without forming a seal. It will be understood, that other constructions may be used and are within the scope of the present disclosure. In one embodiment, a die or press (not shown) is used to cut the apertures 56 of the handle 50. The die or press may be used to cut the apertures 56 together, after the handle 50 is formed. In another embodiment, the upper portion of each handle panel 52, 54 is folded over (e.g., folded back on itself) and attached to the lower portion of the handle panel before the apertures 56 are cut (e.g. the apertures extend through two layers of each handle panel) to increase the strength of the handle panels. The upper and lower portions of each handle panel 52, 54 can be attached to each other with fusion lines or any other suitable means.

Referring to FIGS. 1-5, the bag 10 includes three tear out sections 16, 116, and 216, respectively. Each tear out section 16, 116, 216 is configured to be removed from the bag 10. As described in more detail below, one or more of the tear out sections 16, 116, 216 are removed or torn from the bag 10 to create the exit openings 14 for the user to remove the items or containers C from the bag interior 48 after the receiving opening 12 is closed (the exit openings are, broadly, in communication with the bag interior) (FIGS. 2-3). In the illustrated embodiment, the bag 10 includes three tear out sections 16, 116, 216, however, it is understood the bag 10 need only include one tear out section that forms the exit opening 14 to remove the containers C from the bag interior 48. More than three tear out sections could be provided. Accordingly, a bag 10 having one or more tear out sections (e.g. at least one tear out section) is within the scope of the present disclosure.

Tear out sections 16, 116, 216 are defined by tear lines 72, 172 and 272 respectively. Tear lines 72, 172, 272 are included on each of the top and bottom panels 20, 22 of bag 10. Each tear line 72, 172, 272 on the top and bottom panels 20, 22 defines tear out sections 16*a*, 116*a*, and 216*a*, respectively, on the top and bottom panels (e.g. there is a tear out section 16*a* on the top panel and a corresponding tear out section 16*a* on the bottom panel).

With respect to the front of the bag 10, the tear lines 72 extend over the top and bottom panels 20, 22. Each tear line 72 has a first end 74 on the first side edge margin 28 of the top and bottom panels 20, 22 and a second end 76 on the second side edge margin 30 of the top and bottom panels. Each tear line 72 is located adjacent to and generally parallel with the front side edge margin 24. In the preferred embodiment, the tear lines 72 on the top and bottom panels 20, 22 extend through the gussets 36, 37. However, it is understood the tear lines 72 may not extend through the gussets 36, 37. With respect to the rear of the bag 10, the tear lines 172 extend over the top and bottom panels 20, 22. Each tear line 172 has a first end 174 on the first side edge margin 28 of the top and bottom panels 20, 22 and a second end 176 on the second side edge margin 30 of the top and bottom panels. Each tear line 172 is located adjacent to and generally parallel with the rear side edge margin 26. In the preferred embodiment, the tear lines 172 on the top and bottom panels 20, 22 extend through the gussets 36, 37. However, it is understood the tear lines 172 may not extend through the gussets 36, 37. In the illustrated embodiment, tear lines 72, 172 extend across the entire length L of the bag 10 (FIG. 5). Alternatively, the tear lines 72, 172 may only extend across a portion of the bag 10 (e.g. the length of the tear lines 72, 172 can be adjusted). For example, the first ends 74, 174 of the tear lines 72, 172 can be spaced apart from the first side edge margin 28, or the second ends 76, 176 of the tear lines can be spaced apart from the second side edge margin 30, or both ends can be spaced apart from the side edge margins.

With respect to the side of the bag 10, the tear lines 272 extend over the top and bottom panels 20, 22 and define tear out section 216. Each tear line 272 has a first end 274 and a second end 276. The first and second ends 274, 276 are located at the first side edge margin 28. The first and second ends 274, 276 of each tear line 272 are spaced apart from each other and the front and rear edge margins 24, 26. The distance between the first and second ends 274, 276 defines a width W1 of the tear out section 216 (FIG. 5). The tear lines 272 extend over the top and bottom panels 20, 22. However, the tear lines 272 to not extend to or contact the second side edge margin 30. Thus, every point along the tear lines 272 is spaced apart from the second side edge margin 30. A portion of the tear lines 272 extends over the gusset 36. It is understood that tear out section 216 can be located adjacent to any of the front, rear, first and second side edge margins 24, 26, 28, 30. The bag 10 can also include more than one tear out section 216.

Tear out section 216 is generally located near the middle of the width W of the bag 10 such that a midpoint of the width is located on the tear out section 216. Tear out section 216 extends generally horizontally from the first side edge margin 28 toward the second side edge margin 30. Preferably, the tear out section 216 extends approximately a quarter of the way to the second side edge margin 30 (e.g. a quarter of the length L of the bag 10). Tear out section 216 may extend across the top and bottom panels 20, 22 at other distances without departing from the scope of the present disclosure. Moreover, the tear out section 216 may not extend horizontally across the front and rear panels 20, 22, as shown, but at an angle thereto. It will be understood that the tear out section 216 does not disrupt the continuity of the material of the bag 10 from the first handle panel 52 to the second handle panel 54. Stated another way, a section of the bag material extends from one handle panel 52 to the other handle panel 54 without crossing any zone of weakness such as those formed by perforations. It is possible for the continuity of the section to include joints where material of the bag 10 is strongly and permanently attached together. However, the load of the container C is supported by the section and does not have to be supported through any of the tear lines 72, 172, 272 when the bag 10 is being carried by the handle 50. This will inhibit separation along the tear lines prior to end recipient of the contents of the bag 10 intentionally tearing one or more of the tear sections 16, 116, 216 out.

In the illustrated embodiment, the tear line 272 defines a tear out section 216 that is generally rectangular in shape. The tear lines 272 have a first segment 278 extending from the first side edge margin 28 toward the second side edge margin 30, a second segment 280 extending from the first side edge margin 28 toward the second side edge margin 30, and a third segment 282 extending between and interconnecting the first and second segments. The first, second and third segments 278, 280, 282 are generally linear. The third segment 282 can include rounded ends (corners) at the first and second segments 278, 280 to facilitate the transfer of the ripping or tearing forces between the segments. It is understood that the tear out section 216 can have other shapes without departing from the scope of the present disclosure. For example, the tear out section 216 can have an oval shape or a semi-circular shape.

Tear lines 72, 172, 272 are formed by perforations 80 (e.g., each tear line 72, 172, 272 is made up of perforations). The perforations 80 extend along and define the tear lines 72, 172, 272. The perforations 80 are sized to allow the user to tear or rip the tear out sections 16, 116, 216 from the bag 10 along the tear lines 72, 172, 272, respectively, to create the exit openings 14. For example, tear out section 16 is removed from the bag 10 along tear lines 72 to create the exit opening 14 in FIG. 2. Similarly, tear out section 216 is removed from the bag 10 along tear lines 272 to create the exit opening 14 in FIG. 3. The perforations 80 are sized and arranged to prevent the perforations from ripping under the weight of the items received in the bag interior 48 while the bag 10 is used to transport the items. The perforations 80 can be formed from a single punching operation. In this way, the tear lines 72 on the top and bottom panels 20, 22 are aligned, as are tear lines 172 and tear lines 276. In the preferred embodiment, the perforations 80 have a cut length of 1 to 2 mm (0.04 to 0.08 inches) with an interval between cuts of 2 to 4 mm (0.08 to 0.16 inches), however, other perforation configurations are within the scope of the present disclosure.

The perforations 80 defining tear lines 72, 172, 272 reduces the strength of the top and bottom panels 20, 22, e.g. reduces the amount of weight that can be carried by the bag 10. Accordingly, the perforation 80 configuration can be adjusted to ensure the bag 10 can carry an appropriate amount of weight. Likewise, by adjusting the length of the tear lines 72, 172, 272, as mentioned above, or reducing the number of tear out sections, the strength of the bag can be adjusted to carry an appropriate amount of weight. For example, if the bag 10 only includes tear out section 216, the strength of the bag is better maintained because no tear out section extends across the entire width W of the bag. Accordingly, the bag 10 can carry heavier loads than, for example, a bag with perforations extending across the entire bag width. The bag 10 can also be made of a less expensive, lower strength material. Still further, by maintaining the integrity across an entire portion of the bag 10 (e.g. the perforations 80 do not extend across the entire bag), the strength of the perforations can be adjusted to make it easier (require less force) to remove the tear out section 216, as the strength of the bag is not limited to the strength of the perforations. However, it is understood that it may be beneficial to provide a bag 10 with multiple tear out sections (e.g. two or more of tear out sections 16, 116, 216) to allow the user to choose which tear out sections to remove and/or to provide a single bag that has multiple exit openings 14 to accommodate the various different sized containers C, such as the various different food delivery containers, placed in the bag interior 48. In this case, the configuration of the perforations 80 and the type of material the bag 10 is constructed from can be adjusted to ensure the bag has an appropriate amount of strength.

Referring to FIGS. 1, 2 and 5, tear out section 216 includes a finger slot 82 on the top panel 20. The finger slot 82 is adjacent to the tear line 272 and can be positioned anywhere along the tear line. The finger slot 82 is defined by the tear line 272 and a finger slot line 84. The finger slot line 84 is also formed by perforations 80. The perforations 80 of the finger slot line 84 may the same or different than the perforations 80 of the tear lines 72, 172, 272. The finger slot line 84 extends over the tear out section 216. As described in more detail below, each finger slot 80 is configured to receive a finger of the user to allow the user to better grip the tear out section 216. It is understood that tear out sections 16 and 116 may also include a finger slot.

The size of the tear out sections 16, 116, 216 can vary (e.g. alter the width W1 of tear out section 216 or the length of tear out sections 16, 116) depending upon the needs of the user and the size of the items the bag 10 is designed to carry. As described in more detail below, removing the tear out sections 16, 116, and/or 216 creates the exit opening 14 (FIGS. 2 and 3). Thus, the size of the tear out sections 16, 116, 216 corresponds to the size of the exit opening 14 formed when the tear out sections are removed.

The bag 10 can include one or more vent holes (not shown) located on the top panels 20 to allow steam and/or air to exit the bag interior 48 when a container C containing hot food is placed therein.

The bags 10 can be formed from a unitary sheet of extruded polymeric film material. Such polymeric material can be polypropylene (PP), low-density polyethylene (LDPE), high density polyethylene (HDPE), linear low density polyethylene (LLDPE) or any other suitable material.

The receiving opening 12 of the bag 10 is configured to be "permanently" closed by the user to restrict access to the bag interior 48. In operation, the handle 50 (or other closing component) closes the receiving opening 12 after items or containers C are placed in the bag interior 48 through the receiving opening. More specifically, after the protective release strip is removed, the first and second handle panels 52, 54 are brought together such that the first handle panel is positioned over the adhesive member 68. The first handle panel 52 is then pressed against the adhesive 80 to permanently secure or fix the first and second handle panels 52, 54 together, closing the receiving opening 12 (FIGS. 2 and 3). Once the adhesive 80 bonds to the first handle panel 52, the seal between the first and second handle panels 52, 54 cannot be broken without at least some damage to the bag 10. In this manner, the handle 50 permanently closes the receiving opening 12 of the bag 10 such that opening the bag to access the container C placed in the bag interior 48 requires damaging one of the top and bottom panels 20, 22, the first and second handle panels 52, 54 and/or the gussets 36, 37 such that the bag cannot be reclosed and/or such that the bag having been opened is apparent. In this way, a customer receiving the contents of the bag 10 can perform a quick visual inspection of the bag to check for any damage or signs that the bag interior 48 has been accessed.

Referring to FIGS. 2 and 3, once the bag 10 is permanently closed, the tear out sections 16, 116, 216 enable the bag to be subsequently opened in a controlled but destructive manner. To open the bag 10 after the receiving opening 12 is closed, the user or customer removes one or more of tear out sections 16, 116, 216 to create the one or more exit or second openings 14. It is understood that if tear out sections 16, 116, 216 are all removed from the bag 10, then the bag will have three exit openings 14 (e.g. second, third and fourth openings). To remove the tear out sections 16, 116, 216 from the bag 10, the user rips or tears the top and bottom panels 20, 22 along tear lines 72, 172, 272, respectively, to separate the tear out sections from the bag. If the tear out sections 16, 116, 216 contain finger slots 82, the user presses their finger against the finger slot 82 to separate the tear out section along the tear line 72, 172, 272 and the finger slot line 84. The user then inserts their finger through the finger slot 82 to grip and remove the tear out sections 16, 116, 216. The perforations 80 promote the tearing along the tear lines 72, 172, 272 in a controlled fashion. Once one or more of the tear out sections 16, 116, 216 are removed from the top and bottom panels 20, 22, the exit or second opening 14 is created (e.g. opened) and the user can access the bag interior 48 to remove the one or more containers C therein.

Once closed, the tamper evident bag can only be opened through destructive means such as by damaging the top and bottom panels or removing the tear out sections such that a visual inspection of the bag will reveal whether the contents placed inside the bag interior have been accessed.

For ease of comprehension, where similar or analogous parts are used in the different embodiments, the same reference numbers with one or two primes are employed.

In view of the above, it will be seen that the several features of the invention are achieved and other advantageous results obtained.

Having described the invention in detail, it will be apparent that modifications and variations are possible without departing from the scope of the invention defined in the appended claims. For example, where specific dimensions are given, it will be understood that they are exemplary only and other dimensions are possible.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. As used throughout the present disclosure with respect to the bag, the terms defining relative locations and positions of structures and components of the bag, including but not limited to the terms "top," "bottom," "side," "front," and "rear," are meant to provide a point of reference for such components and structures as shown in the drawings, with the understanding that the respective relative locations of such components and structures will depend on the orientation of the bag in use. In addition, as used throughout the present disclosure with respect to the bag, the terms defining relative numbers of structures and components of the bag, including but not limited to the terms "first," "second," "third," and "fourth," are meant to distinguish similar components and structures as shown in the drawings, with the understanding the respective number of such components and structures will depend on the presence of such other similar components and structures.

As various changes could be made in the above products without departing from the scope of the invention, it is intended that all matter contained in the above description and shown in the accompanying drawings shall be interpreted as illustrative and not in a limiting sense.

What is claimed is:

1. A tamper evident bag comprising:

a top panel and a bottom panel having top and bottom surfaces and front, rear, and opposite first and second side edge margins, the top and bottom panels being connected together along the front, rear and first and second side edge margins to define a bag interior between the top surface of the bottom panel and the bottom surface of the top panel, the top panel defining a receiving opening sized and shaped for inserting one or more items into the bag interior; and a handle connected to the top panel;

the top and bottom panels each having a tear line with a first end and a second end, the first and second ends being located at the first side edge margin, the first and second ends of the tear line being spaced from the front and rear edge margins and from each other, each tear line extending over the top and bottom panels defining a respective tear out section therein, the tear out sections being joined along the first side edge margins and configured to be removed to create an exit opening in the top and bottom panels;

wherein the tear lines are everywhere spaced from the front, rear and second side edge margins.

2. The tamper evident bag of claim 1 wherein the bag has a width extending between the front and rear edge margins and a midpoint along the width of the bag, the midpoint being located on the tear out sections.

3. The tamper evident bag of claim 1 wherein the tear lines on the top and bottom panels are aligned with each other.

4. The tamper evident bag of claim 1 wherein the tear lines are formed of perforations.

5. The tamper evident bag of claim 1 wherein the top and bottom panels are connected together along the first side edge margin with a first gusset and second side edge margin with a second gusset.

6. The tamper evident bag of claim 1 wherein the top and bottom panels each further include a second tear line with a first end and a second end, the first end of the second tear line being located at the first side edge margin and the second end of the second tear line being located at the second side edge margin, each second tear line being adjacent to and generally parallel with the front edge margin, the second tear lines extending over the top and bottom panels defining a respective second tear out section therein, the second tear out sections being joined along the front edge margin and configured to be removed to create a front margin exit opening between the top and bottom panels.

7. The tamper evident bag of claim 6 wherein the top and bottom panels each further include a third tear line with a first end and a second end, the first end of the third tear line being located at the first side edge margin and the second end of the third tear line being located at the second side edge margin, each third tear line being adjacent to and generally parallel with the rear edge margin, the third tear lines extending over the top and bottom panels defining a respective third tear out section therein, the third tear out sections being joined along the rear edge margin and configured to be removed to create a rear margin exit opening between the top and bottom panels.

8. The tamper evident bag of claim 1 wherein the handle is configured to close the receiving opening.

9. The tamper evident bag of claim 8 wherein the top panel comprises a first top panel member and a second top panel member, the first top panel member having front, rear, and opposite first and second side edge margins, the second top panel member having front, rear, and opposite first and second side edge margins, each of the front, rear, and first side edge margins of the first top panel member being connected to at least a portion of the front, rear, and first side edge margins of the bottom panel, respectively, and each of the front, rear, and second side edge margins of the second top panel member being connected to at least a portion of the front, rear, and second side edge margins of the bottom panel, respectively.

10. The tamper evident bag of claim 9 wherein the receiving opening is defined between the second side edge margin of the first top panel member and the first side edge margin of the second top panel member.

11. The tamper evident bag of claim 10 wherein the handle comprises a first handle panel connected to the first top panel member and a second handle panel connected to the second top panel member.

12. The tamper evident bag of claim 11 wherein the first handle panel is connected to the second side edge margin of the first top panel member and the second handle panel is connected to the first side edge margin of the second top panel member.

13. The tamper evident bag of claim 11 further comprising an adhesive member on the second handle panel positioned to adhere to the first handle panel so as to close the receiving opening.

14. The tamper evident bag of claim 13 wherein the first handle panel defines a first aperture and the second handle panel defines a second aperture, the first and second apertures being configured to receive a hand of a user so the user can grasp the bag.

15. The tamper evident bag of claim 11 further including at least one section extending from the first handle panel around the bag to the second handle panel that does not cross any line of weakness formed into the bag whereby a weight carried by the bag can be supported from the first and second handle panels without passing through any line of weakness.

16. A tamper evident bag comprising:

a top panel and a bottom panel having top and bottom surfaces and front, rear, and opposite first and second side edge margins, the top and bottom panels being connected together along the front, rear and first and second side edge margins to define a bag interior between the top surface of the bottom panel and the bottom surface of the top panel, the top panel defining a receiving opening sized and shaped for inserting one or more items into the bag interior, the top and bottom panels having a bag width extending between the front and rear edge margins; and a handle connected to the top panel;

the top and bottom panels each having a tear line with a first end and a second end, the first end being located at the first side edge margin and the second end being located at the second side edge margin, each tear line being adjacent to and generally parallel with the front edge margin, the tear lines extending over the top and bottom panels defining a respective tear out section therein, each tear out section extending from the tear line to the front edge margin of the respective top and bottom panels, each tear out section having a tear out section width extending between the tear line and the front edge margin, the tear out section width being greater than zero and equal to or less than a quarter of the bag width, the tear out sections being joined along the front edge margins of the top and bottom panels, the tear out sections being configured to be removed from the top and bottom panels to create a front margin exit opening between the top and bottom panels, the tear out sections removing the connected front edge margins of the top and bottom panels from the top and bottom panels when the tear out sections are removed from the top and bottom panels to create the front margin exit opening.

17. The tamper evident bag of claim 16 wherein the top and bottom panels each further include a second tear line with a first end and a second end, the first end of the second tear line being located at the first side edge margin and the second end of the second tear line being located at the second side edge margin, each second tear line being adjacent to and generally parallel with the rear edge margin, the second tear lines extending over the top and bottom panels defining a respective second tear out section therein, the second tear out sections being joined along the rear edge margin and configured to be removed to create a rear margin exit opening between the top and bottom panels.

18. The tamper evident bag of claim 16 where the handle is configured to close the receiving opening.

19. The tamper evident bag of claim 18 further comprising an adhesive member fixed to the handle, the adhesive member configured to be secured to a portion of the tamper evident bag to close the receiving opening.

20. A tamper evident bag comprising:

a top panel and a bottom panel having top and bottom surfaces and front, rear, and opposite first and second side edge margins, the top and bottom panels being connected together along the front, rear and first and second side edge margins to define a bag interior between the top surface of the bottom panel and the bottom surface of the top panel, the top panel defining a receiving opening sized and shaped for inserting one or more items into the bag interior; and a handle connected to the top panel;

the top and bottom panels each having a tear line with a first end and a second end, the first and second ends being located at the first side edge margin, the first and second ends of the tear line being spaced from the front and rear edge margins and from each other, each tear line extending over the top and bottom panels defining a respective tear out section therein, the tear out sections being joined along the first side edge margins and configured to be removed to create an exit opening in the top and bottom panels;

the top and bottom panels each further including a second tear line with a first end and a second end, the first end of the second tear line being located at the first side edge margin and the second end of the second tear line being located at the second side edge margin, each second tear line being adjacent to and generally parallel with the front edge margin, the second tear lines extending over the top and bottom panels defining a respective second tear out section therein, the second tear out sections being joined along the front edge margin and configured to be removed to create a front margin exit opening between the top and bottom panels.

* * * * *